US010234823B2

(12) United States Patent
Raggi et al.

(10) Patent No.: US 10,234,823 B2
(45) **Date of Patent: *Mar. 19, 2019**

(54) TIMEPIECE PALLET FORK FOR MECHANICAL OSCILLATOR AND TIMEPIECE TIME-DELAY RELEASE MECHANISM

(71) Applicant: Société anonyme de la Manufacture d'horlogerie Audemars Piguet & Cie, Le Brassus (CH)

(72) Inventors: Lucas Raggi, St-Blaise (CH); Jean-Daniel Lüthi, Russy (CH); Sébastien Lopez, Morteau (FR); Jérôme Kirchhof, Neuchâtel (CH)

(73) Assignee: Sociétéanonyme de la Manufacture d'horlogerie Audemars Piguet & Cie, Le Brassus (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/368,045

(22) Filed: Dec. 2, 2016

(65) Prior Publication Data

US 2017/0082977 A1 Mar. 23, 2017

Related U.S. Application Data

(63) Continuation of application No. 14/709,516, filed on May 12, 2015, now Pat. No. 9,547,277.

(30) Foreign Application Priority Data

May 20, 2014 (EP) ..... 14169042

(51) Int. Cl.
*G04B 15/06* (2006.01)
*G04B 15/08* (2006.01)
(Continued)

(52) U.S. Cl.
CPC ..... *G04B 15/08* (2013.01); *G04B 15/06* (2013.01); *G04B 15/14* (2013.01); *G04B 21/00* (2013.01);
(Continued)

(58) Field of Classification Search
CPC ..... G04B 15/06; G04B 15/08; G04B 15/14; G04B 21/00; G04B 21/027; G04B 21/06; G04B 21/10
See application file for complete search history.

(56) References Cited

U.S. PATENT DOCUMENTS 681,006 A 8/1901 Thim
2,481,213 A 9/1949 Gummersall
(Continued)

FOREIGN PATENT DOCUMENTS

CH 703449 A2 1/2012
CH 706924 A2 3/2014
(Continued)

OTHER PUBLICATIONS

Nicholas et al., English Translation for CH 703449, Jul. 2010, whole document.

(Continued)

*Primary Examiner* — Daniel P Wicklund
(74) *Attorney, Agent, or Firm* — Drinker Biddle & Reath LLP

(57) ABSTRACT

A timepiece pallet fork for a mechanical oscillator including an arbor allowing the timepiece pallet fork to oscillate about a pivot axis, first and second pallets configured to alternatively engage with an escapement wheel when the timepiece pallet fork oscillates, the first pallet being displaceable with respect to the arbor by absorption of energy, the first pallet being displaceable from a first upstream waiting position to a first downstream stopping end position which is offset
(Continued)

compared to the first upstream waiting position, and a first arm having an intermediate section including an elastic bend, one end of the arm being fixed with respect to the arbor to form a first fixed end, the intermediate section of the first arm being located between the first fixed end and the first pallet and returning the first pallet towards the first upstream waiting position by the intermediate section being elastically deformable from a first configuration into a second configuration.

10 Claims, 4 Drawing Sheets

(51) Int. Cl.

| | |
|---|---|
| ***G04B 15/14*** | (2006.01) |
| ***G04B 21/00*** | (2006.01) |
| ***G04B 21/02*** | (2006.01) |
| ***G04B 21/06*** | (2006.01) |
| ***G04B 21/10*** | (2006.01) |

(52) U.S. Cl.
CPC ..... *G04B 21/027* (2013.01); *G04B 21/06* (2013.01); *G04B 21/10* (2013.01)

(56) References Cited

U.S. PATENT DOCUMENTS

| | | | |
|---|---|---|---|
| 4,162,417 | A | 7/1979 | Grudzinski |
| 8,882,339 | B2 | 11/2014 | Colpo et al. |
| 2008/0219103 | A1 | 9/2008 | Baumberger et al. |
| 2010/0208555 | A1 | 8/2010 | Hiraoka et al. |
| 2011/0216633 | A1 | 9/2011 | Pesenti |
| 2015/0124570 | A1 | 5/2015 | Cabezas Jurin et al. |
| 2015/0248112 | A1 | 9/2015 | Stranczl et al. |

FOREIGN PATENT DOCUMENTS

| | | | | |
|---|---|---|---|---|
| EP | 2037335 | A2 * | 3/2009 | ..... G04B 15/08 |
| GB | 574229 | A | 12/1945 | |

OTHER PUBLICATIONS

Search Report dated Feb. 19, 2015 in counterpart European Patent Application No. 14 16 9042.

* cited by examiner

TIMEPIECE PALLET FORK FOR MECHANICAL OSCILLATOR AND TIMEPIECE TIME-DELAY RELEASE MECHANISM

CROSS-REFERENCE TO RELATED APPLICATIONS

The present application is a continuation application of U.S. patent application Ser. No. 14/709,516, filed May 12, 2015, which claims priority to European Patent Application No. 14169042.0 filed on May 20, 2014, the entire contents each of which is incorporated herein by reference.

TECHNICAL FIELD OF THE INVENTION

The present invention relates to the field of horology. More specifically, the present invention is directed to a timepiece pallet fork for a mechanical oscillator and a timepiece time-delay release mechanism.

STATE OF THE ART

Timepiece time delay release mechanisms are integrated into diverse devices to enable determining instants of release therein. In particular, such mechanisms are the basis for the functioning of striking works of timepieces in which successive strikes of one or more gongs indicate the hour acoustically.

Conventionally, a timepiece time-delay release mechanism can comprise an escapement wheel and a mechanical oscillator. An oscillating pallet fork of the mechanical oscillator comprises two pallets which are alternately engaged with the toothing of the escapement wheel. In this way, the regular oscillations of the timepiece pallet fork regulate the intermittent rotation of the escapement wheel.

Each pallet receives the impact of a tooth of the escapement wheel before stopping momentarily this escapement wheel. The successive impacts of the teeth of the escapement wheel on the pallets produce a clicking sound which can be undesirable. In particular in the case where the timepiece time delay release mechanism makes a mechanical striking work of a timepiece function, this clicking sound interferes with the sounds produced by the striking work of the timepiece.

Described in the patent GB 574,229 is a pallet fork which is intended to be silent. In this pallet fork, each pallet is borne by a flexible blade which connects it to a pallet fork arm. The pallet fork described in the patent GB 574,229 is cumbersome.

SUMMARY

According to one aspect of the invention, a timepiece pallet fork for a mechanical oscillator is provided. Preferably, the timepiece pallet fork includes an arbor having a pivot axis, the timepiece pallet fork configured to oscillate about the pivot axis, and first and second pallets configured to alternatively engage with an escapement wheel when the timepiece pallet fork oscillates about the pivot axis, the first pallet being displaceable with respect to the arbor by absorption of energy, the first pallet being displaceable from a first upstream waiting position to a first downstream stopping end position which is offset compared to the first upstream waiting position, a downstream direction being a direction of progression of a tooth of the escapement wheel before a stopping of the tooth by the first pallet. Moreover, the timepiece pallet fork preferably includes a first arm having an intermediate section including an elastic bend, one end of the arm being fixed with respect to the arbor to form a first fixed end, the intermediate section of the first arm being located between the first fixed end and the first pallet and returning the first pallet towards the first upstream waiting position by the intermediate section being elastically deformable from a first configuration, in which the first pallet is in the first upstream waiting position, into a second configuration, in which the first pallet is in the first downstream stopping end position.

The first pallet is adapted to be displaced by the tooth which it is in the process of stopping. An absorption of energy takes place when the first pallet is thus displaced, which damps the stop of the tooth. As a result, a substantially less loud, or imperceptible, clicking is achieved.

Use of a pallet fork according to the features fo the present invention thus makes it possible to reduce the noise impact represented by the clicking sound produced by an escapement during its operation. The bend in this pallet fork enables the intermediate section to have the desired elasticity without being too long or too thin.

The timepiece pallet fork defined above can incorporate one or more other advantageous features, alone or in combination, in particular from among those defined in the following.

Preferably, the second pallet is displaceable with respect to the arbor with an absorption of energy, from an second upstream waiting position to a second downstream stopping end position which is offset with respect to the second upstream waiting position, downstream considering the direction of progression of a tooth of the escapement wheel before a stopping of this tooth by the second pallet. In this case, the timepiece pallet fork comprises a return device for returning the second pallet towards the second upstream waiting position. In this case, the clicking sound produced by the operation of an escapement comprising the pallet fork is even less loud insofar as each stop of the escapement wheel is damped.

Preferably, the timepiece pallet fork comprises a second arm, an intermediate section of which comprises an elastic bend and one end of which is fixed with respect to the arbor, the second arm defining the second pallet, the return device being an elastic return device comprising the intermediate section of the second arm, this intermediate section of the second arm being located between the fixed end of the second arm and the second pallet, and being elastically deformable from a first configuration, in which the second pallet is in the second upstream waiting position, into a second configuration, in which the second pallet is in the second downstream stopping end position.

Preferably, the timepiece pallet fork comprises a stop for stopping the first arm downstream, with respect to the arbor, as soon as the first pallet is in its downstream stopping end position. When such is the case, it is possible to obtain a damping which is great while being compatible with a correct operation of the timepiece pallet fork.

Preferably, the stop is formed by the arbor, and the arbor and the fork can be an integral element. In such a case, a simplification of the timepiece pallet fork can be obtained.

Preferably, the timepiece pallet fork comprises two rigidly connected pieces, which are an assembly piece bearing the arbor and an attached piece defining the first arm. In such a case, the timepiece pallet fork can easily have a simple and compact structure.

Preferably, the stop is formed by an outer portion of a pin rigidly fixed in the assembly piece. When such is the case, the timepiece pallet fork can easily have a simple and compact structure.

Preferably, the assembly piece is an inertia mass of a mechanical oscillator. When such is the case, the inertia mass fulfils in addition the function of a piece holding together all or some of the other pieces of the timepiece pallet fork, which permits additional design simplification.

The invention likewise has as subject matter a timepiece time delay release mechanism. This timepiece mechanism comprises a mechanical energy storage device, a rotating escapement wheel driven by mechanical energy provided by the storage device, and a mechanical oscillator comprising a timepiece pallet fork such as previously defined. The timepiece pallet fork co-operates with the escapement wheel in such a way as to regulate an intermittent rotation of this escapement wheel.

Preferably, the timepiece time delay release mechanism is a timepiece striking works comprising a gong, a percussion hammer for striking this gong, as well as a device of repetitive actuation of the hammer according to a rate determined by the intermittent rotation of the escapement wheel.

BRIEF DESCRIPTION OF THE SEVERAL VIEWS OF THE DRAWINGS

Other advantages and features will become more clearly evident from the description which will follow of a special embodiment of the invention given by way of non-limiting example and represented in the attached drawings, of which.

DESCRIPTION OF THE PREFERRED EMBODIMENTS

Figure 1:
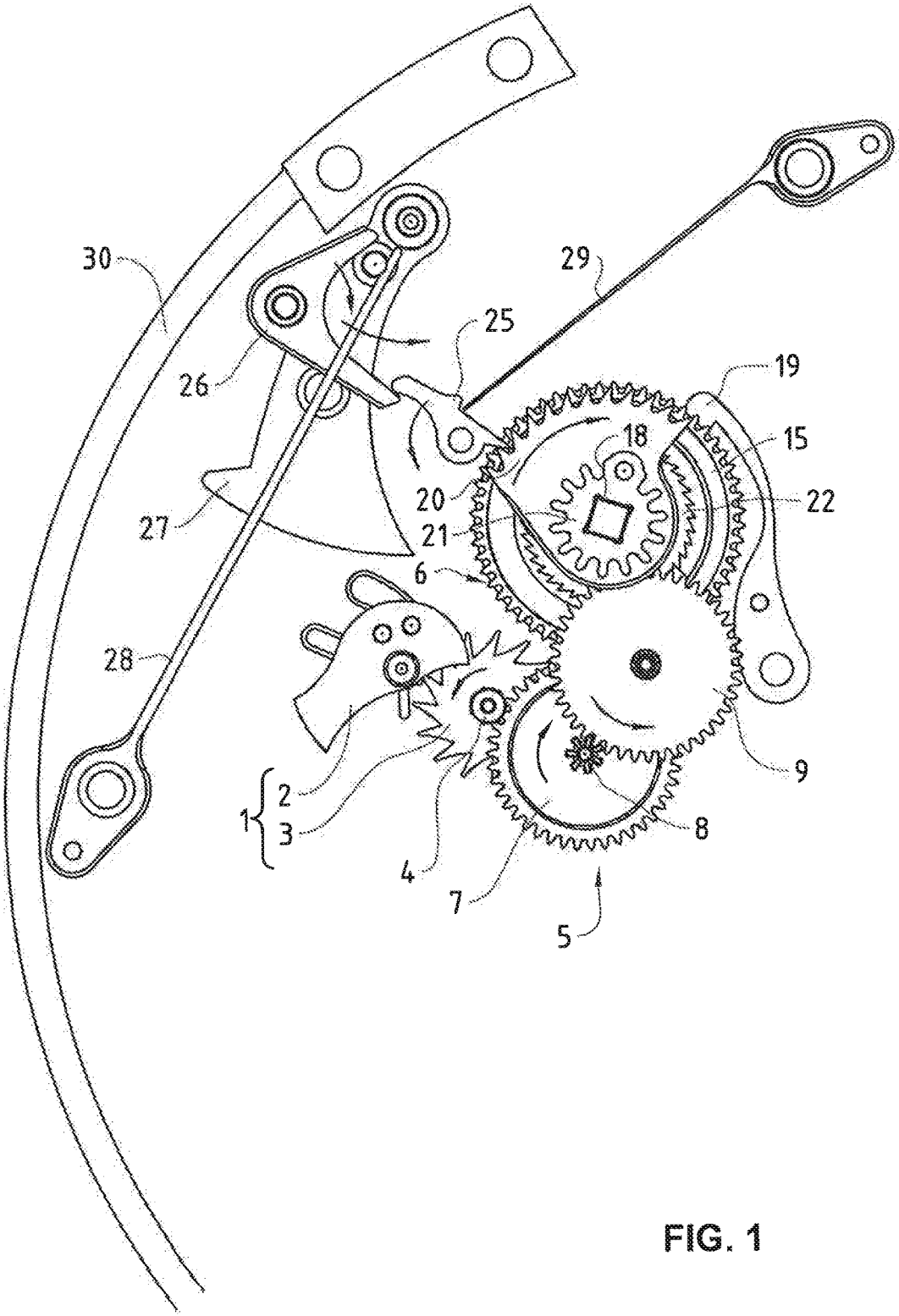
FIG. 1 is a plan view of a timepiece time delay release mechanism according to an aspect of the invention and which is more specifically the mechanism of a mechanical striking works of a watch.

In FIG. 1, a timepiece time delay release mechanism according to an embodiment of the invention is more specifically a mechanical striking works of a watch.

Although its application in mechanical striking works of a watch is preferable in particular with all or some of the features of the embodiment of FIG. 1, the invention is not limited to mechanical striking works of a watch. For example, the invention can be incorporated into a mechanism of an automaton in order to control the speed of animation.

The timepiece time delay release mechanism represented in FIG. 1 comprises an escapement 1, in which a timepiece pallet fork 2 is connected to an escapement wheel 3 in such a way as to be able to regulate the intermittent rotation.

A pinion 4 integral with the escapement wheel 3 forms part of a gear-train 5 which couples this escapement wheel 3 to a barrel 6 forming a mechanical energy storage device. Besides the pinion 4, the gear-train 5 comprises a wheel 7 meshing with the pinion 4, a pinion 8 integral with this wheel 7, as well as a wheel 9 meshing with the pinion 8.

Figure 2:
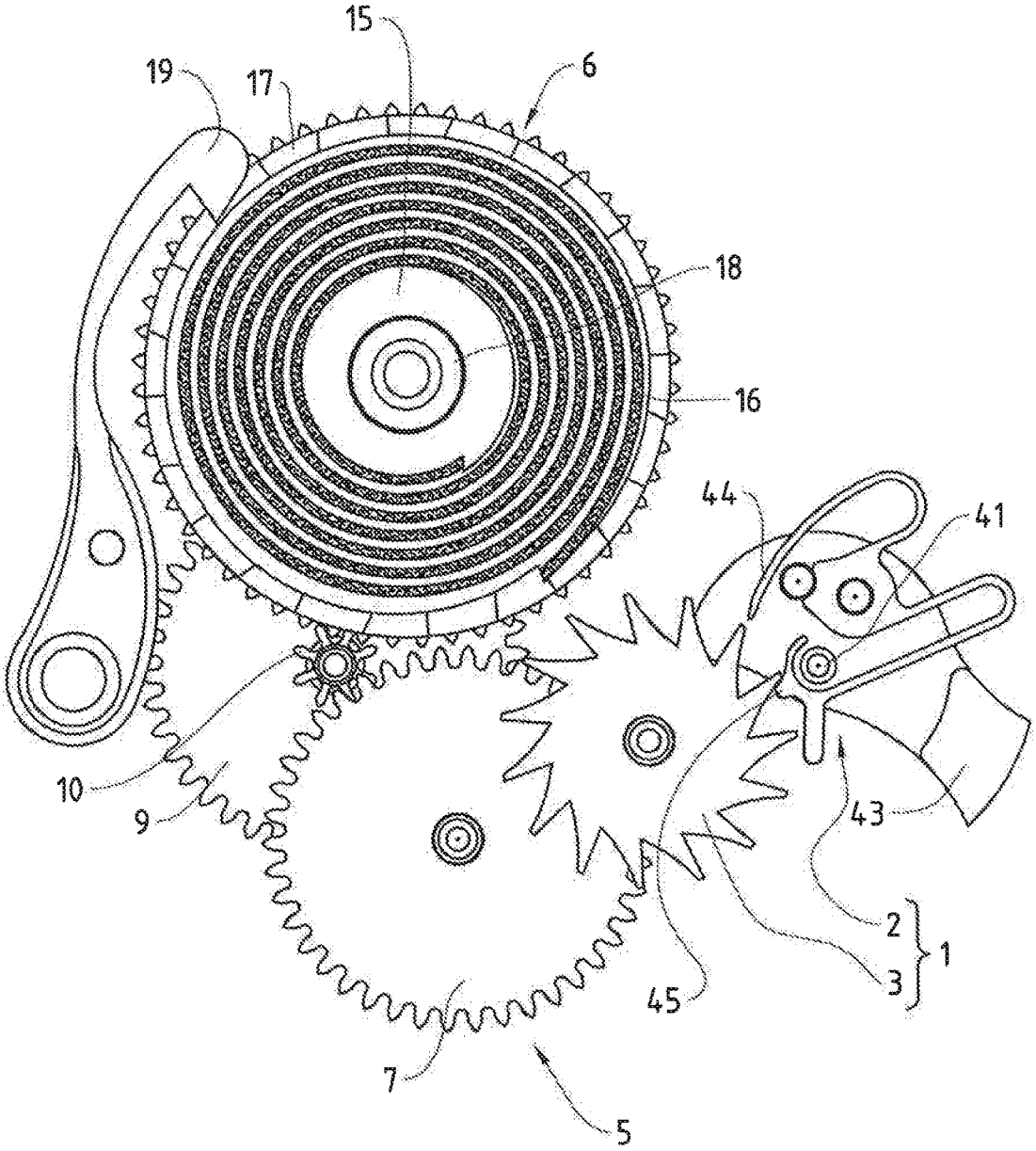
FIG. 2 is a plan view which represents a constituent sub-mechanism of the mechanical striking works of FIG. 1 and in which the angle of view is the opposite of that of this FIG. 1.

As can be seen in FIG. 2, the gear-train 5 likewise comprises a pinion 10 which is integral with the wheel 9 and which meshes with the peripheral toothing of a constituent barrel-drum 15 of the barrel 6.

Still in FIG. 2, the barrel 6 comprises a barrel spring 16, whose one end is blocked by an adjusting ring 17. The other end of this barrel spring 16 is attached to a barrel-arbor 18. A hook 19 retains the adjusting ring 17 in an angular position that can be selected from among a multiplicity of possible angular positions for adjusting a pretensioning or prewinding of the barrel spring 16.

Again in FIG. 1, a toothed section 20 and a rack-pinion 21, provided to receive a winding up movement from a rack (not shown), are integral with the barrel-arbor 18, which is rotational about the same axis as the barrel-drum 15. A ratchet 22 forms part of a partially visible ratchet mechanism, provided to couple the barrel-drum 15 to the barrel-arbor 18 only when this barrel-arbor 18 delivers the energy provided by the barrel spring 16 and turns in the clockwise direction in FIG. 1. A winding up, i.e. a winding of the barrel spring 16, is carried out with a driving of the rack-pinion 21 in the reverse direction. At the time of such a winding, the rack-pinion 21 and the barrel-arbor 18 are driven without driving in turn the barrel-drum 15, which can hence remain stationary, as is also the case for the gear-train 5 and the escapement 1.

A winding and release lever 25 mounted in a pivoting way is disposed in such a way as to be able to be actuated by each of the twelve teeth of the toothed section 20. It co-operates with an angled transmitting lever 26, which is provided to displace a swinging hammer 27 and to lead it into a starting position by a launching spring 28 for this hammer 27. The winding and release lever 25, the transmitting lever 26 and the swinging hammer 27 constitute a drive chain, at the end of which is located the launching spring 28. A counter-spring 29 is provided to act on the other end of this drive chain. The launching spring 28 and the counterspring 29 bring back alternately, in one direction and then in the other, the winding and release lever 25, the transmitting lever 26 and the swinging hammer 27 in contact with one another.

After having been wound then released, the barrel spring 16 provides the energy driving the whole mechanism of the striking works of FIG. 1, in which the arrows indicate the directions of movement then present. The average speeds within the gear-train 5 are regulated by the escapement 1. As the barrel 6 drives this gear-train 5, its average speed in particular is regulated by the escapement 1.

As always, when the barrel 16 delivers the energy stored during a prior winding, at least one tooth of the toothed section 20 passes in front of the winding and release lever 25 and actuates it. The tooth makes this winding and release lever 25 pivot in the direction of a winding of the launching spring 28. When the winding and release lever 25 then unhooks itself from the tooth carrying on its advance, the launching spring 28 starts the hammer 27 toward a gong 30, the striking of which by this hammer 27 leads to the emission of a sound.

The amount of winding up of the barrel 6 determines the number of teeth successively actuating the winding and release lever 25. The duration between two successive strikes of the gong 30 by the hammer 27 depends on a rate controlled by the escapement 1, since it is the average speed of rotation of the toothed section 20. In conclusion, the escapement 1, the gear-train 5, the barrel 6 and the toothed section 20 together form a mechanism which establishes a delay between two successive strikes of the gong 30 and which actuates the sub-mechanism operating these successive strikes.

Figure 3:
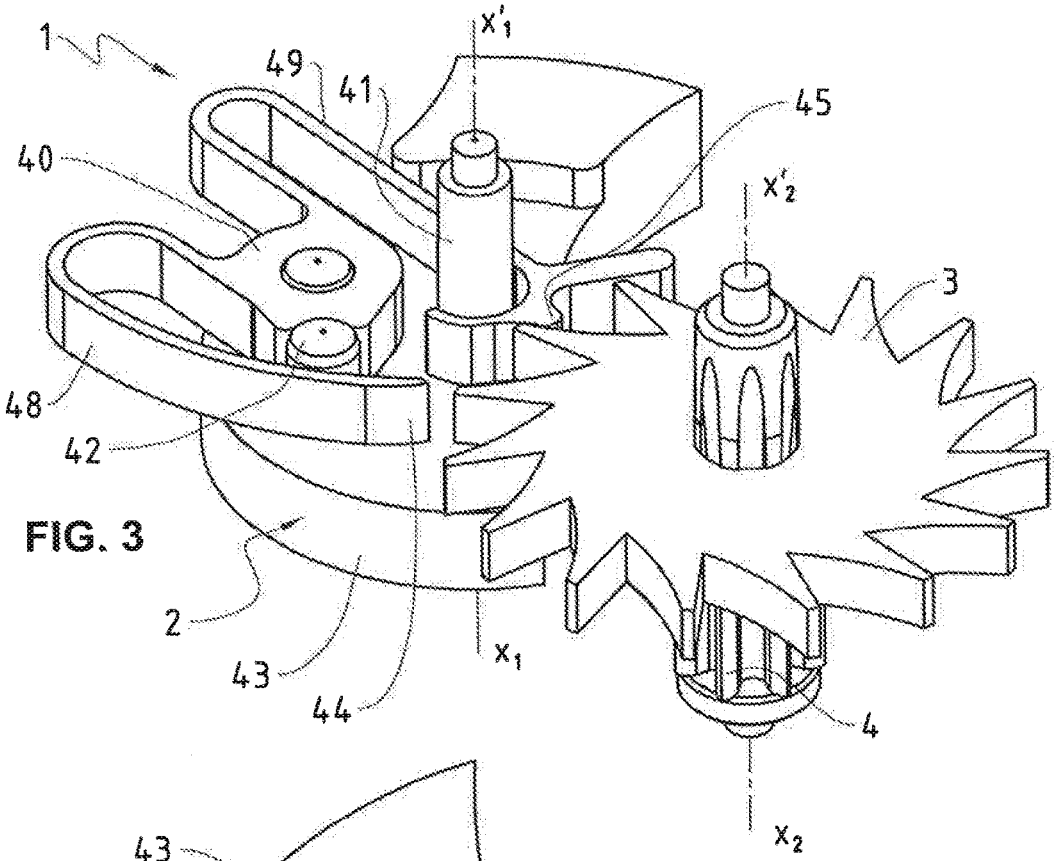
FIG. 3 is a perspective view of a constituent escapement of the mechanical striking works represented in FIG. 1.

The escapement 1 is represented alone in FIG. 3, where it can be seen that the timepiece pallet fork 2 results from the assembly of an attached piece 40, an arbor 41 and a pin 42 on an assembly piece which is an inertia mass 43. In the embodiment described, the inertia mass 43 is a constituent part of the pallet fork 2, and this pallet fork 2 forms in itself the mechanical oscillator. It can however be otherwise, and, within the mechanical oscillator, the pallet fork and the inertia mass can be two distinct elements, coupled together, without departing from the scope of the invention.

By means of the arbor 41, the pallet fork 2 is mounted in a way so as to be pivoting about a pivot axis $X_1$-$X_1$' parallel to the axis of rotation $X_2$-$X'_2$ of the escapement wheel 3.

In the sense understood here, the pallets are hooking beaks, also referred to as pallet stones in the field of horology. The attached piece 40 defines the upstream pallet 44 and the downstream pallet 45 of the pallet fork 2. In the present description and in the attached claims, the terms "before", "upstream" and "downstream" as well as similar terms refer to the direction of progression of a tooth of the escapement wheel at the pallets.

Figure 4:
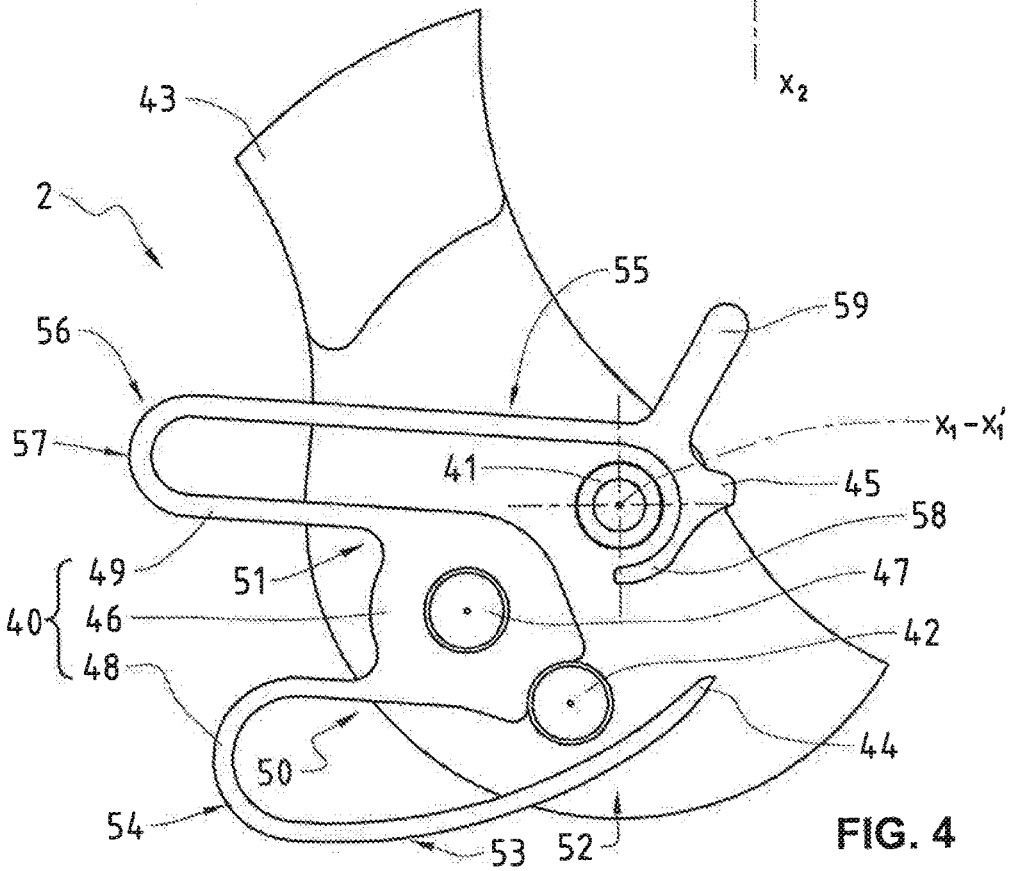
FIG. 4 is a plan view of a timepiece pallet fork according to another aspect of the invention, which forms part of the escapement represented in FIG. 3.
Figure 7:
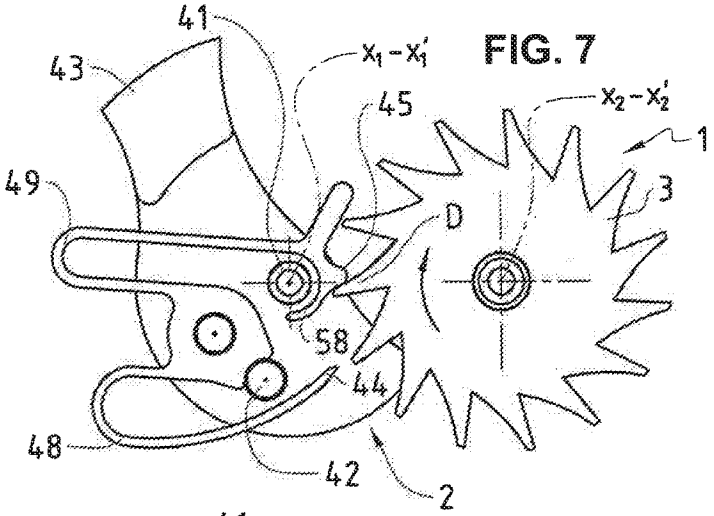
FIGS. 5 to 8 are similar plan views, each of which represents the escapement of FIG. 3 at one of four successive instants during the operation of this escapement.

As can be seen in FIG. 4, the attached piece 40 comprises a rigid body 46, which an assembly pin 47 assembles rigidly into the inertia mass 43. The pin 42 participates in the rigid assembly of the rigid body 46 into the inertia mass 43 by preventing any possibility of pivoting of these elements with respect to one another about the assembly pin 47. The attached piece 40 likewise comprises two elastically flexible arms, i.e. an upstream arm 48 and a downstream arm 49, each of which comprises a fixed end 50 or 51 connecting to the rigid body 46.

A section of the upstream arm 48 forms a hooking finger 52 terminated by the pallet 44. An intermediate section 53 of the arm 48 connects the fixed end 50 and the hooking finger 52 to one another. This intermediate section 53 has the form of a blade which is elastically flexible in such a way that the hooking finger 52 is displaceable until a stop constituted by an outer portion of the pin 42. An elastic bend 54 reduces the bending stiffness of the intermediate section 53.

A section of the upstream arm 49 forms a hooking finger 55 terminated by the pallet 45. An intermediate section 56 of the arm 49 connects the fixed end 51 and the hooking finger 55 to one another. This intermediate section 56 has the form of a blade which is elastically deformable in such a way that the hooking finger 55 is displaceable downstream. An elastic bend 57 reduces the stiffness of the intermediate section 56. A return section 58 of the arm 49 prolongs the hooking finger 55 beyond the pallet 45, upstream then in the direction opposite to the escapement wheel 3. The arbor 41 forms a stop for this return section 58 and thus limits the possibility of displacement of the hooking finger 55 downstream.

The downstream arm 49 bears a downstream blocking tail 59, able to place itself between two consecutive teeth of the escapement wheel 3, in such a way as to prevent them from turning in the wrong direction.

Figure 5:
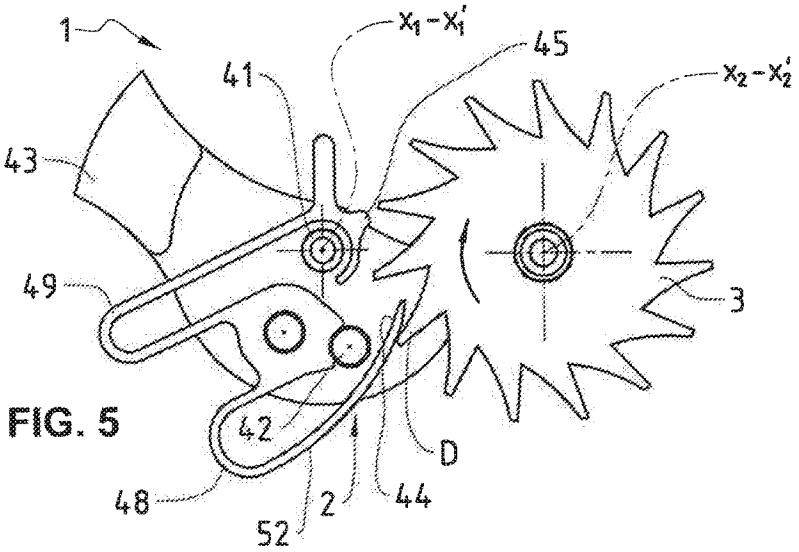
Figure 6:
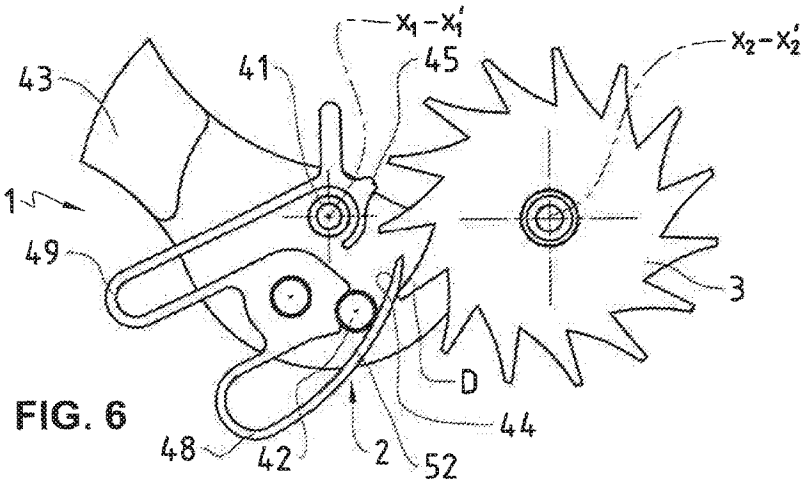

FIGS. 5 to 8 illustrate the operation of the pallet fork 2. In FIG. 5, the escapement wheel 3 driven by the gear-train 5 turns in clockwise direction, and one of its teeth, indicated as D, encounters the upstream pallet 44, without being stopped immediately by it. Then, under the pushing of the tooth D driven in particular by the inertia of the escapement wheel 3 and by that of the gear-train 5, the upstream arm 48 curves elastically, in particular at its elastic bend 54, which leads to a progressive absorption of kinetic energy and a likewise progressive deceleration of the escapement wheel 3. The elastic deformation of the arm 48 comes to an end when its hooking finger 52 encounters the pin 42 which stops it, which occurs in FIG. 6. In this FIG. 6, the escapement wheel 3 is momentarily stopped.

While the damped stop of the tooth D by the upstream pallet 44 occurs, the pivoting movement of the pallet fork 2 about its pivot axis $X_1$-$X'_1$ reverses, following which the upstream pallet 44 begins a backward movement with respect to the escapement wheel 3. This backward movement leads the upstream pallet 44 away from the tooth D, which releases the escapement wheel 3. Once distanced from the tooth D, the upstream arm 48 assumes again its initial form with a dissipation of the elastic potential energy which it has stored during its damping of the stop of the tooth D.

The backward movement of the upstream pallet 44 is accompanied by a forward movement of the downstream pallet 45 with respect to the escapement wheel 3, which has started to turn again. This leads to the situation represented in FIG. 7, where the tooth D encounters the downstream pallet 45. As before, the tooth D is then slowed down progressively in a first step, which is then the result of the downstream arm 49 which is deformed elastically in the direction of a rebound.

Figure 8:
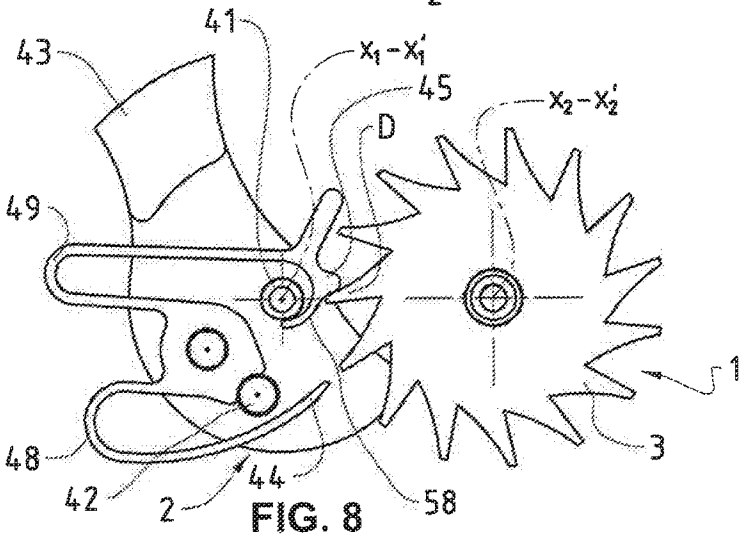

The elastic deformation of the downstream arm 49 comes to an end when the return section 58 encounters the arbor 41 which stops it. The arbor 41 then fulfils a stopping function for the downstream arm 49, which FIG. 8 illustrates. The pivoting movement of the pallet fork 2 about its pivot axis $X_1$-$X'_1$ reverses again, during the damped stop of the tooth D by the downstream pallet 45. Once distanced from the tooth D, the downstream arm 49 assumes again its initial form with a dissipation of the elastic potential energy which it has stored during its damping of the stop of the tooth D.

The intermittent stops of the escapement wheel 3 by the pallets 44 and 45 are damped. This leads to a substantial reduction of the clicking sound produced by the operation of the escapement 1.

The invention is not limited to the previously described embodiment. In particular, in a timepiece pallet fork also according to the invention, the attached piece 40 can be mounted swinging on the inertia mass 43 and brought back toward a waiting position by an additional spring, in which case the arms 48 and 49 can be rigid, or even omitted.

According to another possibility still within the scope of the invention, the two hooking fingers 52 and 55 can be mounted swinging at a distance from one another. In this case, each of them can bear a lever arm able to act on the lever arm of the other hooking finger. These lever arms are arranged in such a way that any one hooking finger displaced downstream is going to have its lever arm actuate the lever arm of the other hooking finger in the direction of a bringing back upstream of this other hooking finger.

The invention claimed is:

1. A timepiece pallet fork for a mechanical oscillator, comprising:

an arbor having a pivot axis, the timepiece pallet fork configured to oscillate about the pivot axis; and first and second pallets configured to alternatively engage with an escapement wheel when the timepiece pallet fork oscillates about the pivot axis, the first pallet being displaceable with respect to the arbor by absorption of energy from a first upstream waiting position to a first downstream stopping end position which is offset compared to the first upstream waiting position, a downstream direction being a direction of progression of a tooth of the escapement wheel before a stopping of the tooth by the first pallet; and a first arm having an intermediate section including an elastic bend such that the first arm has a rigidity in a plane substantially parallel to the pivot axis that is higher than a rigidity of the first arm in a plane substantially perpendicular to the pivot axis, one end of the arm being fixed with respect to the arbor to form a first fixed end, the intermediate section of the first arm being located between the first fixed end and the first pallet, wherein the intermediate section is elastically deformed from a first configuration, in which the first pallet is in the first upstream waiting position, into a second configuration, in which the first pallet is in the first downstream stopping end position, to return the first pallet towards the first upstream waiting position.

2. The timepiece pallet fork according to claim 1, wherein the second pallet is displaceable with respect to the arbor by absorption of energy, from a second upstream waiting position to a second downstream stopping end position which is offset with respect to the second upstream waiting position, a downstream direction being a direction of progression of a tooth of the escapement wheel before a stopping of the tooth by the second pallet, the timepiece pallet fork further comprising:

a return device configured to return the second pallet towards the second upstream waiting position.

3. The timepiece pallet fork according to claim 2, further comprising:

a second arm having an intermediate section including an elastic bend, one end of the second arm being fixed with respect to the arbor to form a second fixed end, the return device including an elastic return device forming the intermediate section of the second arm, the intermediate section of the second arm being located between the second fixed end of the second arm and the second pallet, and being elastically deformable from a first configuration, in which the second pallet is in the second upstream waiting position, into a second configuration, in which the second pallet is in the second downstream stopping end position.

4. The timepiece pallet fork according to claim 1, further comprising:

a stop configured to stop the first arm downstream, with respect to the arbor, as soon as the first pallet is in the first downstream stopping end position.

5. The timepiece pallet fork according to claim 4, wherein the stop is formed by the arbor.

6. The timepiece pallet fork according to claim 1, further comprising:

an assembly element borne by the arbor; and an attached element defining the arm, wherein the assembly element and the attached element are rigidly attached to each other.

7. The timepiece pallet fork according to claim 6, further comprising:

a stop configured to stop the first arm downstream, with respect to the arbor, as soon as the first pallet is in the first downstream stopping end position, wherein the stop is formed by an outer portion of a pin rigidly fixed in the assembly element.

8. The timepiece pallet fork according to claim 6, wherein the assembly element includes an inertia mass of a mechanical oscillator.

9. A timepiece time delay release mechanism comprising:

a mechanical energy storage device;

a rotating escapement wheel driven by mechanical energy provided by the mechanical energy storage device; and a mechanical oscillator including the timepiece pallet fork according to claim 1, the timepiece pallet fork cooperating with the escapement wheel to regulate an intermittent rotation of the escapement wheel.

10. The timepiece time delay release mechanism according to claim 9, wherein the timepiece time delay release mechanism is a timepiece striking works including a gong, a percussion hammer configured to strike the gong, and a device configured to repetitively actuate the hammer according to a rate determined by the intermittent rotation of the escapement wheel.

* * * * *